United States Patent [19]

Makarenko

[11] Patent Number: 4,796,908

[45] Date of Patent: Jan. 10, 1989

[54] SKI BINDING

[76] Inventor: Vladimir S. Makarenko, prospekt Kultury, 11,korpus 1, kv. 279, Leningrad, U.S.S.R.

[21] Appl. No.: 44,366

[22] PCT Filed: Apr. 18, 1986

[86] PCT No.: PCT/SU86/00034

§ 371 Date: Dec. 12, 1986

§ 102(e) Date: Dec. 12, 1986

[87] PCT Pub. No.: WO86/06291

PCT Pub. Date: Nov. 6, 1986

[30] Foreign Application Priority Data

Apr. 26, 1985 [SU] U.S.S.R. ..... 3880000

[51] Int. Cl.[4] ..... A63C 9/10

[52] U.S. Cl. ..... 280/615

[58] Field of Search ..... 280/615, 614, 611, 613, 280/633, 634, 635

[56] References Cited

U.S. PATENT DOCUMENTS 4,487,427 12/1984 Salomon ..... 280/615

FOREIGN PATENT DOCUMENTS 3115618 3/1982 Fed. Rep. of Germany .
3240750 5/1984 Fed. Rep. of Germany .
2466259 4/1981 France .

*Primary Examiner*—David M. Mitchell
*Assistant Examiner*—Michael Mar
*Attorney, Agent, or Firm*—Burgess, Ryan & Wayne

[57] ABSTRACT

A ski binding comprises rest pins 1 and corresponding holes 3 for mating with the rest pins 1 disposed on a ski 2 or on a boot 5 and a lock 6, restraining vertical movement of the boot 5. The pins 1 and the corresponding holes 3 are placed along the longitudinal axis of the ski 2 and the boot 5.

4 Claims, 5 Drawing Sheets

SKI BINDING

FIELD OF THE INVENTION

The invention relates to sporting gear, and more specifically, to ski binding for cross-country skis.

Today we witness the dramatic growth and changes of the standards that the sporting gear must meet. As the skating stride is gaining popularity, it has become necessary to enhance the ski boot sole resistance to twisting, because the skier over a long period of time runs on the ski edge. But in this case the sliding surface of the ski (and the boot sole surface as well) forms a substantial angle with the surface of the ski-track (condensed snow) when the skier pushes, bringing about strong twisting moments with respect to the boot sole.

BACKGROUND OF THE INVENTION

At present an "Adidas" ski binding is widely used, that consists of a plate with side-frames set at an angle to the longitudinal axis of the ski. The plate size and the value of the side-frames slope are determined by the size and shape of the boot sole toe. The binding is designed for use with a ski boot that has a projecting toe portion of the boot sole. The binding lock is designed in the following way. The plate carries a pin to which a lever is fixed that has still another pin at its free end. To this latter pin a second lever is fixed in its turn, the free end thereof holding down the flange of the boot sole toe portion. To lock the boot, the skier must rest the end of the second lever against the boot flange and press the first lever which in this case keeps turning until the line connecting the two pins becomes lower than the line connecting the first pin with the rest point. In this position the boot gets locked. Disadvantages of said binding include its considerable weight, low adaptability to manufacture, relative complexity of the lock design and considerable torques arising in the plane perpendicular to the boot sole surface when the skier pushes, the latter disadvantage being especially serious when a skating stride is used. Strong sole twisting is caused not only by the binding design but also by a narrow sole toe portion of a standard "Racing Norm 38" type boot which has a narrower toe as compared to a "Racing Norm 50" boot.

A ski binding of the "Rotafella" type is widely used nowadays. This binding is also designed as a plate with side-frames set at an angle to the longitudinal axis of the ski. As distinct from the "Adidas" binding it has three pins directly on the plate, which mate with the corresponding holes in the boot sole toe portion. The boot is locked with a shackle, free ends of which are set in sleeves of the side-frames. In the foremost part of the binding there is an axle carrying a notched plate. The boot is placed in such a way that the holes in the boot sole toe portion mate with the pins. Then the skier presses the shackle into engagement with one of the notches in the plate. The binding may have different types of locks depending on the modification. Secure boot locking and a smaller torque occuring in the plane perpendicular to the ski longitudinal axis as compared to the "Adidas" binding mentioned above may be cited as advantages of said binding. Disadvantages include its considerable weight, relatively low adaptability to manufacture and relative complexity of the lock manufacture.

There is a prior art ski binding comprising rest pins, of two parts each (cf. laid-open FRG Patent Application No. 3240750). One part of the pin is directly fixed in the ski (boot) body, and the other part fits in a corresponding hole in the boot (ski). If the bottom part of the pin is fixed in the ski body, then, in order to lock the boot it is necessary to place it so that upper parts of the pins fit in the corresponding holes in the boot sole toe portion. To restrain the boot vertical movement various locks are employed. Advantages of said binding include relatively high adaptability to manufacture and simple design, its quick mounting and dismantling, use of different types of locks. Disadvantages include relatively poor functional qualities of the binding when locking and unlocking the boot because this can be done only manually.

A prior art binding (cf. FRG Patent No. C 8425984.I) comprises ski-mounted rest pins for mating with corresponding holes in the boot sole toe portion and a lock featured as a bracket-shaped blade spring one end thereof attached to the ski while the other is designed to straddle from above the boot sole toe portion. High adaptability to manufacture, low production cost, small overall dimensions, light weight, automatic (no need to use hands) locking of the boot to the ski may be cited among its advantages. But this binding may be used only with ski boots that have a projecting sole toe portion or a welt. Accordingly, if a horizontal component force perpendicular to the ski longitudinal axis occurs when the skier pushes, then a substantial torque is developed, so the skier's push zone does not coincide with the boot lock zone. Said disadvantage is characteristic of all types of binding designed for use with the projecting boot toe portion and is most clearly manifested when a skating stride is used.

SUMMARY OF THE INVENTION

The invention is directed to the provision of a ski binding that should make it possible to considerably reduce the action of breaking forces originating during skiing on the ski and the boot sole.

The problem is solved by that in a ski binding comprising rest pins and corresponding holes disposed on a ski or on a boot and a lock restraining the boot vertical movement, according to the invention, the pins and the corresponding holes are placed along the longitudinal axis of the ski and the boot.

Said design of the ski binding provides for quick shifting of the boot along the ski longitudinal axis depending on the skiing technique used and weather conditions. When a skating stride is used it is expedient that the boot sole locking zone be transferred towards the fore-end of the ski which provides for better ski control. Such situations occur when skiing on ice, frozen snowcrust and wet snow when it is more important to considerably improve the ski control notwithstanding some deterioration of its sliding properties. Generally, it may be said that the best sliding is assured if the boot toe is placed in the ski centre of gravity area. Shifting the boot in either direction along the longitudinal axis of the ski makes sliding worse. The possibility of shifting the boot locking zone along the ski longitudinal axis provides for the skier's choosing the optimum boot locking zone with regard for concrete weather conditions and the track profile.

In the preferred embodiment of the invention one of the holes is designed for mating with one of the pins while the other hole is shaped as a longitudinal groove for mating with other pins. Said design of the binding makes it possible for the longitudinal groove to accommodate a different number of pins. A single groove design for a number of pins shows better adaptability to manufacture than a one hole-one pin design.

It is expedient that the pins introduced into the longitudinal groove be rigidly joined forming a longitudinal ridge. Such a design of the binding makes it possible to bring down the unit load per unit of pins area when the boot sole twists. The latter is especially important in case of sliding stride because considerable forces develop both in the ski and in the boot.

It is very practicable that the pins be rigidly joined to each other forming a longitudinal ridge while the corresponding holes are connected to each other forming a longitudinal groove, the length of the groove being at least three times its width. Said design of the binding is highly adaptable to manufacture and provides not only for lower unit load per unit of the longitudinal ridge area, but also for more uniform stress concentration in the boot sole in the longitudinal groove zone, which improves operating characteristics of the binding and the boot. As a consequence, it reduces the boot sole twisting.

BRIEF DESCRIPTION OF THE DRAWINGS

Other objects and advantages of the present invention will become clear from the following, detailed description of specific embodiments thereof and from the accompanying drawings, wherein.

FIG. I represents the ski binding, according to the invention, wherein the rest pins are placed along the longitudinal axis of the ski (side view).

BEST MODE OF CARRYING OUT THE INVENTION

Figure 1:
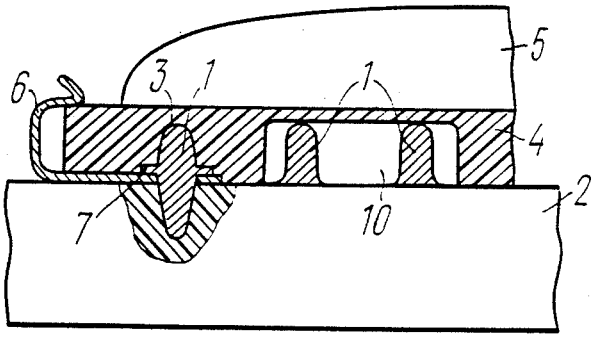
Figure 2:
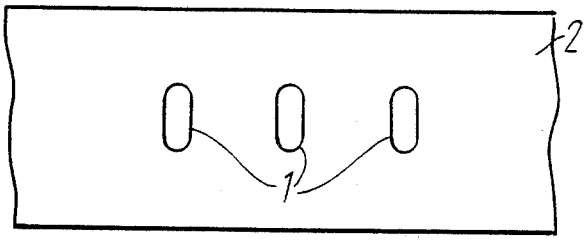
FIG. 2 is the same (top view)
Figure 3:
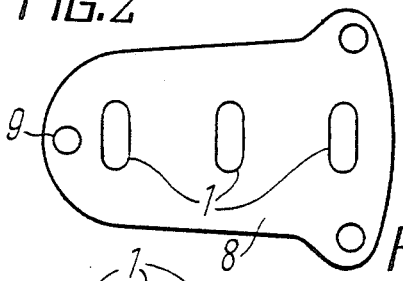
FIG. 3 is an embodiment of the invention, wherein the pins are plate-mounted (top view)
Figure 4:
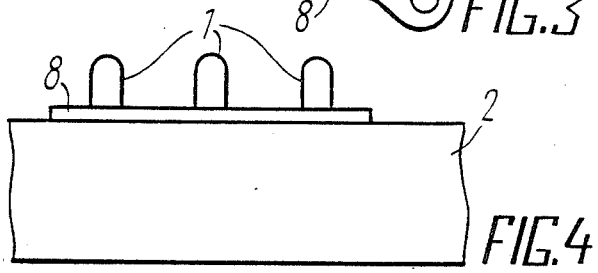
FIG. 4 is the same (side view)

The proposed design of the ski binding comprises rest pins 1 (FIGS. 1–4) mounted on a ski 2 along its longitudinal axis for mating with corresponding holes 3 in the sole 4 of the boot 5, placed along the longitudinal axis of the boot 5. A bracket-shaped lock 6 limits the vertical movement of the boot 5. To provide for easier mounting and dismantling of the binding a rest pin 1 consists of two parts. The bottom fastening part of the pin 1 is fastened in the body of the ski 2, while its top part mates with a corresponding hole 3 in the sole 4 of the boot 5. The top and bottom parts of the pin 1 may be divided by a support 7 used for fixing the lock 6 to the ski 2 (FIG. 1). To provide for higher adaptability of the binding to manufacture the rest pins 1 may be mounted on a plate 8 which has holes 9 for fastening elements that fix the plate 8 to the ski 2 (not shown).

Figure 5:
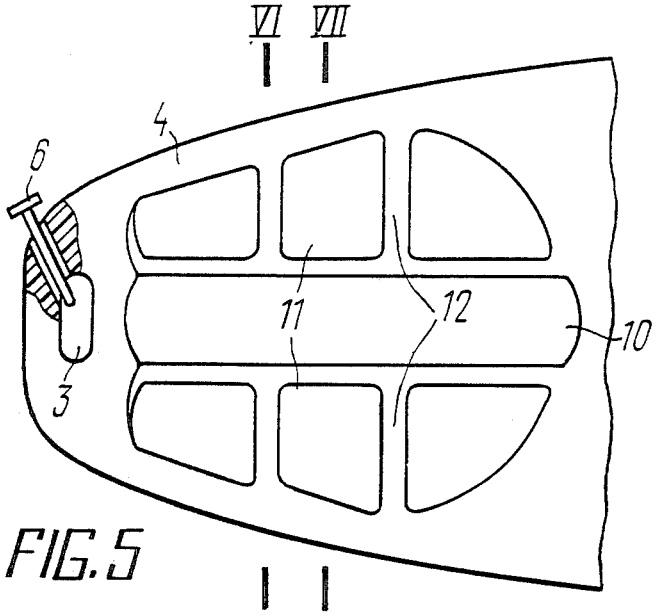
FIG. 5 is a modification of the boot sole design.
Figure 6:
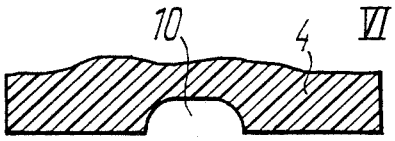
FIG. 6 represents section VI—VI in FIG. 5.
Figure 7:
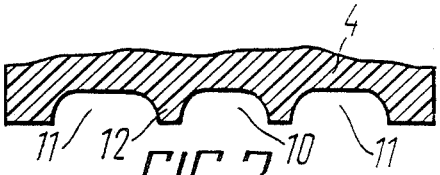
FIG. 7 represents section VII—VII in FIG. 5.

According to one embodiment of the invention, the sole 4 of the boot 5 has two holes 3 one of which is designed to mate with one of the pins 1 while the other hole is shaped as a longitudinal groove 10 for mating with other pins 1. In this embodiment the lock 6 (FIG. 5) is designed as a bar that passes through the sole 4 via the hole 3 to meet the corresponding pin 1.

For better buckling of the sole 4 in the vertical plane parallel to the longitudinal axis of the ski 2, the sole 4 has recesses 11. To enhance the rigidity of the sole 4 in twisting the latter is provided with stiffening ribs 12 (FIGS. 5–9).

Figure 10:
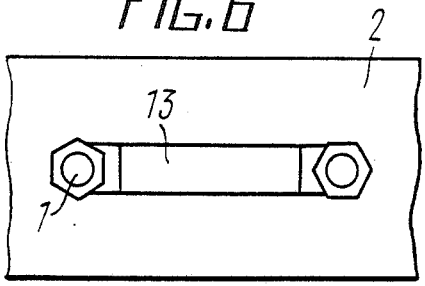
FIG. 10 is an embodiment of the ski binding (top view)
Figure 11:
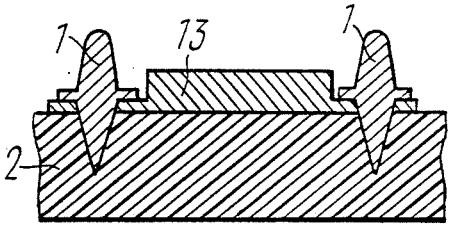
FIG. 11 is the same (cross-section)
Figure 8:
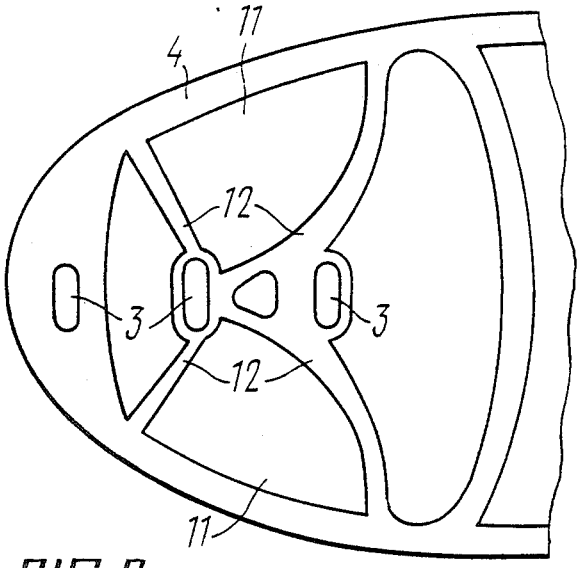
FIG. 8 is a modification of the boot sole design.
Figure 9:
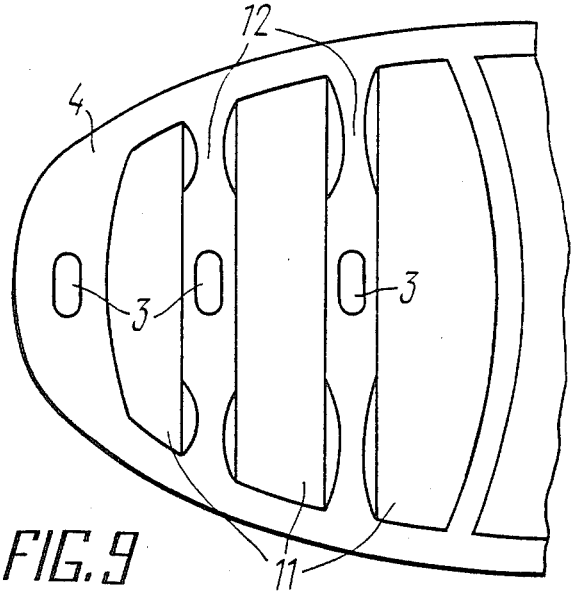
FIG. 9 is a modification of the boot sole design.

FIGS. 10–11 show an embodiment of the proposed ski binding, wherein the pins 1 inbetween the extreme pins 1 are rigidly joined with each other forming a longitudinal ridge 13. Both the extreme pins 1 and the ridge 13 are designed for mating with the corresponding holes 3 and the groove in the sole 4 of the boot 5 (not shown). In said embodiment the pins 1 serve to restrain the displacement of the boot 5 with respect to the longitudinal axis 2 and the ridge 13 serves to limit the lateral movements of the boot 5.

Positioning the pins 1 along the axis of the ski 2 makes it possible to shift the boot 5 along the ski 2 and to lock it. When the boot 5 is fixed on the pin 1 which is nearest to the toe of the ski 2 it creates a more favourable conditions for the skier using a skating stride due to a more confident control of the toe of the ski 2. The rest of the pins 1 engage the holes 3 of the sole 4 of the boot 5 and prevent the twisting of sole 4 of the boot 5 when the skier pushes, thus unloading the first pin 1 upon which the boot 5 is fixed.

It is desirable to space the pins 1 along the axis of the ski 2 in such a way that notwithstanding any bending of the sole 4 of the boot 5 when the skier runs, at least two of the pins 1 mounted along the longitudinal axis of the ski 2 would remain in the holes 3 or the groove 13.

The lock 6 (FIG. 5) is mounted in the sole 4 of the boot 5 to provide for locking the boot 5 upon any of the pins 1 by means of one lock 6. The lock 6 is fixed in the sole 4 in such a way that the adjacent pins 1 would not interfere with locking and unlocking the boot 5.

The binding operates as follows. To lock the boot 5 (FIG. I) it is necessary to align the rest pin 1 with the corresponding hole 3 in the sole 4. After that it is necessary to apply force so that the pin 1 could enter the hole 3. When the pin 1 enters the hole 3 the toe portion of the sole 4 of the boot 5 presses out the lock 6 and then, upon entering of the pin 1 into the hole 3, the lock 6 straddles the sole 4 of the boot 5 from above. According to the embodiment of the ski binding shown in FIG. 5, the pin 1 entering the hole 3 presses out the lock 6. Upon alignment of the axes of the lock 6 and a corresponding opening (not shown) in the pin 1 the lock 6 under the action of the force exerted by the skier enters the opening in the pin 1 and locks the sole 4 of the boot 5 with respect to the ski 2. To unlock the boot 5 it is necessary to apply force from the pin 1 along the axis of the lock 6. As soon as the lock 6 disengages the opening in the pin 1 it becomes possible to unlock the boot 5.

Figure 12:
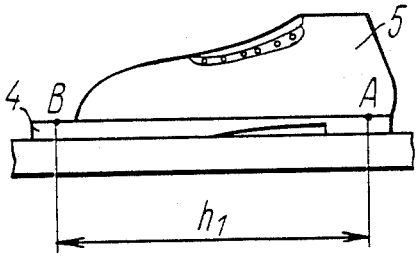
FIG. 12 shows the positioning of the boot on the ski (side view)
Figure 13:
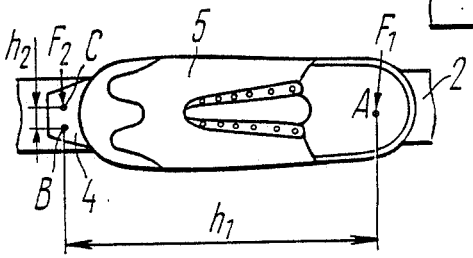
FIG. 13 is the same (top view)

Further, let us explain the essence of the effect produced by said binding design (FIGS. 12–13). Point A to which force $h_1$ is applied when the skier is pushing is at a distance of $h_l$ from point B where the boot 5 is locked to the ski 2. Let us assume that there exists another point C disposed on the axis which is perpendicular to the longitudinal axis of the ski 2 taking up, together with point B, the torque created by the force $F_1$. The distance from point B to point C is $h_2$ and is limited by the standard width of the ski equal to 45 mm (placing point C outside the ski 2 causes a negative consequence, i.e. a decrease in speed through the snow friction of the binding). It can be said that $F_1h_l=F_2h_2$, where $F_2$ is the force applied to the sole 4 of the boot 5 the binding and the ski 2 in point C. Having divided the sole 4 into separate parts it should be noted that on account of a considerable distance between these parts and points B and C they are exposed to substantial torques. We get a completely different picture if point C is removed along the ski axis a distance of $>h_2$, thus considerably reducing both the force $F_2$ that destroys the boot-binding-ski system and the torques attacking parts of the sole 4. The proposed design of the ski binding makes it possible to considerably reduce the twisting of the sole 4 and permits shifting the locking point of the boot 5 along the longitudinal axis of the ski 2.

Figure 14:
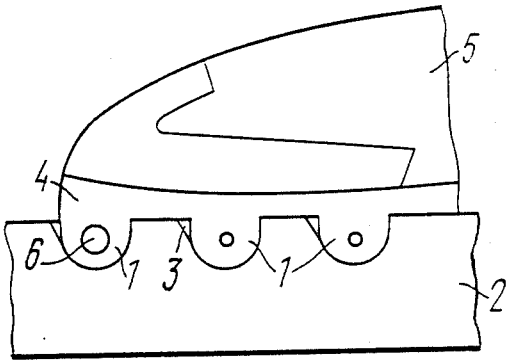
FIG. 14 is an embodiment of the ski binding, according to the invention, wherein the pins are mounted on the boot and the corresponding holes are made in the ski.
Figure 15:
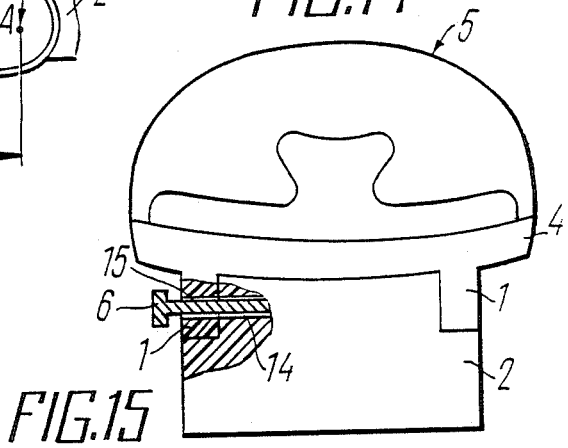
FIG. 15 is the same (front view)

In the embodiment shown in FIGS. 14–15 the rest pins 1 are mounted directly on the sole 4 of the boot 5 along its longitudinal axis in such a way that upon their mating with the corresponding holes 3 in the ski 2 the outward lateral surface of the pin 1 and the corresponding lateral surface of the ski 2 are disposed in the same plane. The ski 2 and the pin 1 are provided with openings 14 and 15 correspondingly for inserting the lock 6 acting as an axis of rotation. Making the forepart of the sole 4 of some elastic damping material (for example, rubber) provides for better conditions for turning the boot 5 in the vertical plane along the axis of the ski 2.

The embodiment shown in FIGS. 14–15 operates in the following way. The rest pins 1 and the corresponding holes 3 are aligned so that the axes of the openings 14, 15 coincide. Upon alignment of the axes of the openings 14, 15 the lock 6 is inserted into them thus providing for locking the boot 5 with respect to the ski 2.

To unlock the boot 4 it is necessary to withdraw the lock 6 from the ski 2.

Figure 16:
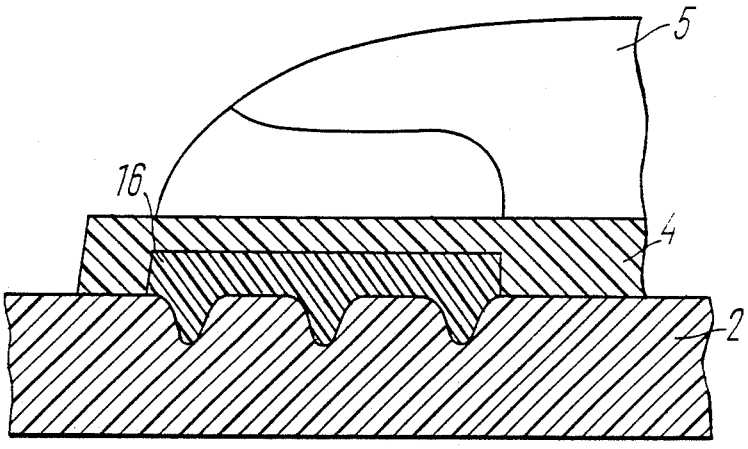
FIG. 16 shows an embodiment of the ski binding (longitudinal section)
Figure 17:
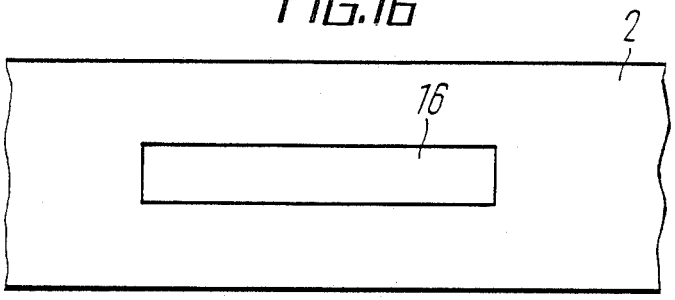
FIG. 17 shows a ridge mounted on the ski (top view)
Figure 18:
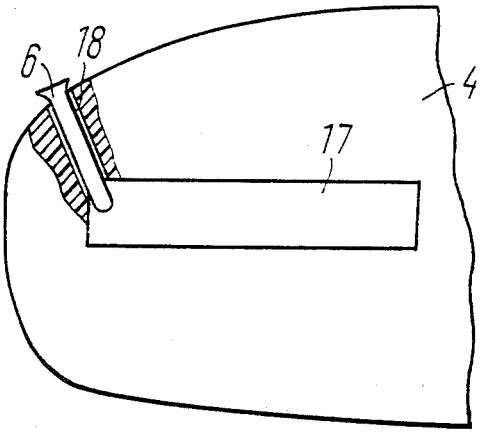
FIG. 18 shows a groove made in the boot sole (bottom view).

In FIGS. 16–18 the pins 1 on the ski 2 are rigidly joined to each other forming a longitudinal ridge 16, while the corresponding holes 3 in the sole 4 of the boot 5 are connected to each other forming a corresponding longitudinal groove 17. The lock 6 is inserted into the groove 17 via a hole 18 in the sole 4 of the boot 5 for contacting the ridge 16. The length of the ridge 16 is at least three times its width. With a smaller value of this ratio the binding design will have no advantages as compared to a traditional transverse position of the pins 1 with respect to the axis of the ski 2 from the point of view of the twisting of the sole 4. The possibility of widening the ridge 16 for reducing the twisting of the sole 4 is limited as it is necessarily accompanied by an increase in the width of the groove 17 which considerably weakens the sole 4 and, consequently, brings about the opposite result, i.e. increases the twisting. An increase in the ratio of the length of the ridge 16 to its width lessens the twisting of the sole 4. It is practicable to reduce the width of the ridge 16 while at the same time increasing its length. But the possibility of reducing the width of the ridge 16 is limited by the necessity of preserving the strength of the ski binding. Increasing the length of the ridge 16 and the groove 17 brings about an unjustified increase in the weight of the ski binding.

Industrial Applicability

The invention may be used both for sporting, cross-country skis and for tourist cross-country skis when the skier uses skating stride. It is recommended that the pins and the corresponding holes disposed on the ski and the boot be placed along their longitudinal axis.

I claim:

1. A ski binding comprising:

a plurality of rest pins disposed on one of a ski and the bottom surface of a ski boot along a longitudinal axis thereof, said rest pins having substantially the same shape;

a plurality of holes for mating with said rest pins, disposed on the other of said ski and ski boot along the longitudinal axis thereof, such that any of said pins can be selectively fitted within selected ones if said holes for varying the location of the ski boot relative to the ski along the longitudinal axis thereof, thereby restraining said boot on said ski in a manner dependent on the type of skiing to be performed; and lock means for locking the forwardmost one of said pins and said holes being disposed on the ski boot to a selected one of said pins and said holes disposed on the ski.

2. A ski binding according to claim 1; wherein at least one hole is designed to mate with a single pin and at least one other hole is shaped as a longitudinal groove for mating with at least two other pins.

3. A ski binding according to claim 2; wherein said pins introduced into the longitudinal groove are joined rigidly so as to form a longitudinal ridge.

4. A ski binding according to claim 1; wherein said pins are rigidly joined to each other to form a longitudinal ridge and the holes corresponding thereto are connected to each other to form a longitudinal groove, the length of the groove being at least three times its width.

* * * * *